US006289198B1

(12) United States Patent
Kawamura et al.

(10) Patent No.: US 6,289,198 B1
(45) Date of Patent: Sep. 11, 2001

(54) QUICK HEAT ROLLER

(75) Inventors: Takao Kawamura, Sakai; Tsuyoshi Nishi, Osaka, both of (JP)

(73) Assignees: Daiken Chemical Co., Ltd.; Takao Kawamura, both of Osaka (JP)

( * ) Notice: Subject to any disclaimer, the term of this patent is extended or adjusted under 35 U.S.C. 154(b) by 0 days.

(21) Appl. No.: 09/509,916

(22) PCT Filed: Aug. 3, 1999

(86) PCT No.: PCT/JP99/04194

§ 371 Date: Apr. 4, 2000

§ 102(e) Date: Apr. 4, 2000

(87) PCT Pub. No.: WO00/08527

PCT Pub. Date: Feb. 17, 2000

(30) Foreign Application Priority Data

Aug. 4, 1998 (JP) ..... 10-254487
Aug. 4, 1998 (JP) ..... 10-254488
Aug. 5, 1998 (JP) ..... 10-255936

(51) Int. Cl.[7] ..... G03G 15/20
(52) U.S. Cl. ..... 399/333; 492/46
(58) Field of Search ..... 399/330, 332, 399/333, 334, 69; 219/216; 432/60, 228; 492/8, 46, 56

(56) References Cited

U.S. PATENT DOCUMENTS 4,618,240 * 10/1986 Sakurai et al. ..... 399/334 X
4,745,431 * 5/1988 Kogure et al. ..... 399/69
5,724,637 * 3/1998 Senba et al. ..... 399/333
5,729,814 * 3/1998 Suzuki et al. ..... 399/333
5,906,762 * 5/1999 Okabayashi ..... 399/333 X

FOREIGN PATENT DOCUMENTS

S61-148471 7/1986 (JP) .
S64-38987 2/1989 (JP) .
H8-69862 3/1996 (JP) .
H8-305197 11/1996 (JP) .
H9-179426 7/1997 (JP) .

* cited by examiner

*Primary Examiner*—Arthur T. Grimley
*Assistant Examiner*—Hoan Tran
(74) *Attorney, Agent, or Firm*—Koda & Androlia

(57) ABSTRACT

A temperature-controlled quick heat roller having an electrical resistance heater sheet provided on an inner surface of the cylinder. The electrical resistance heater is made of at least a high-temperature-coefficient resistance layer so that when the high-temperature-coefficient resistance layer is heated by an electric current, the cylinder is set to a prescribed fixing temperature. Also, the heat roller has a property in which heating electrical power drops as the temperature thereof rises.

6 Claims, 5 Drawing Sheets

QUICK HEAT ROLLER

TECHNICAL FIELD

The present invention relates to toner-fixing heat rollers in electrophotographic systems such as copiers and printers, and more particularly to a quick heat roller that provides rapid heating and long service life and is also provided with a temperature controlled property and self-temperature controlled property such that as temperature rises heating electrical power is constrained.

BACKGROUND ART

In general, toner-fixing heat rollers in electrophotographic systems such as copiers and printers consist of heat rollers with heating means, and pressure rollers are disposed opposite the heat rollers. Recording paper to which a toner image has been transferred is passed between the two rollers so that heat and pressure are simultaneously applied to the paper in order to fix the toner image on the paper.

Such heat rollers have long comprised a photoemission-type heater tube such as a halogen lamp inserted in an aluminum or stainless steel pipe. Because the heat rollers use radiant heat, however, they are quite inefficient, and it can take anywhere from several tens of seconds to a few minutes to heat the heat rollers to the temperatures required for thermofixing (e.g. 160° C.). This is especially problematic in photocopiers, where office efficiency is impaired by the long waits required before the machine is ready to resume copying after long, or even short, periods of non-use.

In recent years, copiers are hooked to other electronic equipment. In such systems, when a copier in the off or idle state receives a signal input, the system can be tied up for an extended period while waiting for the heat roller to reach operating temperature. This makes the copier a major obstacle to system speed. Regardless of how much faster the other equipment in the system becomes, it will be very difficult to achieve any significant gains in electrophotographic system speed without radical improvement in the area of toner fixing.

Further, a photoemission-type heater tube constantly generates light/heat, and it will heat the roller above the temperature that is set for it. To prevent this, heaters are controlled by an external circuit to turn them off and on when they reach a temperature near the desired setting. An undesirable side effect of this on/off control is heat roller temperature oscillation. If the amplitude of this oscillation (ripple) is large enough, it could, over time, result in toner thermofixing irregularity. Efforts to eliminate this problem causes the cost of the on/off control circuits to increase, and a small amount of irregularity still remained.

In addition, these photoemission-type heater tubes are basically glass lamps; and therefore, they are highly susceptible to damage from shock. Therefore, the heat rollers that contained these heater tubes requires very careful handling, and this reduces work efficiency. At the same time, these heat rollers consume a large amount of electrical power. Even when they are not in use, they need to be pre-heated, which is detrimental to energy conservation.

So as to mitigate these problems, methods that requires no photoemission-type heater tubes has been proposed. In this proposed heater roller, an electrical insulation layer made up of a highly heat-resistant organic resin such as polyimide is formed on the outer surface of a fixing heat roller (a cylinder made of a metal pipe); a resistive heating layer is provided on the outer surface of this electrical insulation layer; and finally, on the surface of this, a release layer of a material such as TEFLON (fluorocarbon resin) is formed (as disclosed in Japanese Patent Application Laid-Open (Kokai) Nos. S55-72390, S62-20038, and S63-158582). The idea behind this is that rapid heating of the entire heat roller can be achieved by heating the resistive heating layer by electric current.

Studies of this heat roller conducted by the inventor(s) of the present invention, however, revealed serious weaknesses that preclude its practical application. The materials used for the release layer and electrical insulation layer formed on the outer surface of the metal pipe are organic resins, and they are low in hardness. The recording paper is fed between the heat roller and a pressure roller under high pressure. Therefore, the release layer, which is exposed to the surface, and the electrical insulation layer lying just under it are acted on directly by external pressure. This makes them highly susceptible to damage.

Furthermore, a peeler finger for stripping the recording paper from the roller is provided in contact with the outer surface of the heat roller, and also a temperature sensing thermistor that is pressed against the outer surface is provided in contact with a certin amount of pressure. As a result, the outer surface of the heat roller is highly subject to damage and rapid wear. If the wear is allowed to progress to where the resistive heating layer is exposed, it can lead to unexpected problems such as electrical shorting. For the above reasons, this approach is impractical and therefore doomed to failure, and this technology has not, in fact, replaced photoemission-type heater tubes, which are still in use today. Moreover, there has been absolutely no solution to the temperature ripple problem.

Also, advances in digital technology have resulted in the introduction to the market of color copiers and of multifunction electrophotographic systems that integrate copier, printer, and fax functions in one machine. In particular, these multifunction systems are capable of handling papers of various sizes. For example a machine might process a sheet of B-5-size paper followed immediately by a sheet of A-4 or A-3 paper. After a sheet of B-5 paper passes over the heat roller, drawing heat from it, the portion of the roller that made contact with the paper will be much cooler than the rest of the roller. In other words, the temperature distribution across the surface of the roller will be extremely uneven, resulting in toner fixing irregularities for any larger-than-B5 sheets that follow a B-5 sheet through the machine. This problem is especially apparent in color copiers.

Japanese Patent Application Publication (Kokoku) No. H7-109531 proposes a system for providing uniform temperature distribution across the surface of the fixing heat roller by adjusting an electrical resistance heater so that a greater amount of heat would be applied to paper in the ready position before it reaches the heat roller. With a paper size mix ranging from B-5 through A-3, however, this system is not capable of keeping the temperature distribution constant through momentary changes in paper size.

To summarize, nothing in the past technology is capable of providing long service life, safety, fast heating, rapid correction of temperature irregularities to provide constant temperature, and temperature ripple control, all at the same time. There is still a need for a fresh approach to improvements in these areas of deficiency.

DISCLOSURE OF INVENTION

A first quick heat roller according to the present invention is a toner-fixing quick heat roller characterized in that it comprises an electrical resistance heater sheet provided on the inner surface of a cylinder, the electrical resistance heater sheet comprising at least a resistive heating layer; wherein the resistive heating layer is heated by electric current, for setting the cylinder to a prescribed fixing temperature.

A second quick heat roller according to the present invention is a temperature-controlled quick heat roller characterized in that it comprises an electrical resistance heater sheet provided on the inner surface of a cylinder, the electrical resistance heater sheet comprising at least a high-temperature-coefficient resistance layer; wherein the high-temperature-coefficient resistance layer is heated by electric current, for setting the cylinder to a prescribed fixing temperature, and has a property such that as temperature rises, heating electrical power is constrained.

A third quick heat roller according to the present invention is a self-temperature controlled quick heat roller characterized in that it comprises an electrical resistance heater sheet provided on the inner surface of a cylinder, the electrical resistance heater sheet comprising at least a resistive heating layer further comprising a high-temperature-coefficient resistance layer and a low-temperature-coefficient resistance layer; wherein said high- and low-temperature coefficient resistance layers are both heated by electric current, for setting the cylinder to a prescribed fixing temperature quickly, and are provided with a self-temperature controlled property such that as temperature rises, heating electrical power drops, maintaining the fixing temperature constant.

Also proposed is a quick heat roller wherein a heat reflection layer is provided outermost on one side surface of the electrical resistance heater sheet, and this heat reflection layer is placed innermost in the cylinder.

Also proposed is a quick heat roller wherein the electrical resistance heater sheet is a layered sheet comprising a three-layer configuration such that disposed in layers on a first insulation layer are a resistive heating layer and a second insulating layer, in that order, and the electrical resistance heater sheet is tightly bonded to the inner surface of the cylinder.

Further proposed is a quick heat roller wherein the electrical resistance heater sheet is a layered sheet comprising a four-layer configuration such that disposed in layers on a first insulation layer are a resistive heating layer, a second insulating layer, and a heat reflection layer, in that order; and the electrical resistance heater sheet is tightly bonded to the inner surface of the cylinder.

Also proposed is a quick heat roller wherein at least a resistive heating layer of the electrical resistance heater sheet is made by a screen printing method, and the thickness of the resistive heating layer is controlled through multi-layer printing.

Studies were conducted by the inventors to investigate the above weaknesses related to earlier heat rollers and proposals for improvements to eliminate those weaknesses. As a result of these studies, the inventors conceived that these weaknesses could be overcome by forming insulation layers and resistive heating layers within a cylinder. This first type of quick heat roller in which a resistive heating layer is formed on an inside surface is referred to as a 'toner-fixing quick heat roller.' By forming this layer on an inside surface, contact with the peeling finger and thermistor are avoided, which eliminates wear, thus extending service life, and also improving safety. Moreover, since the resistive heating layer can be made in the form of a sheet that can be heated by electric current, with the sheet in intimate contact with the entire inner surface of the cylinder, this configuration provides extremely rapid heating.

So as to enable the layers to be easily formed for placement inside of the cylinder, the layers are first laminated in the shape of a sheet to form an electrical resistance heater sheet. This electrical resistance heater sheet is then tightly bonded to the inside surface of the cylinder by cementing or fusion, thus providing improved practicality, and making a breakthrough improvement for electrophotographic equipment.

The inventors further conceived that by way of forming the electrically heated resistance layer with a high-temperature-coefficient material, the temperature ripple phenomenon that occurs at high temperatures could be controlled. This second type of quick heat roller is referred to as a 'temperature-controlled quick heat roller.'

In general, if a resistive heating layer is heated by application of a constant voltage, its temperature will gradually increase. The resistance R of the heater will normally increase with increasing temperature in accordance with a relationship expressed by the linear approximation $R=R_o(1+\alpha t)$ where the rate of increase $\alpha$ is the temperature coefficient. More precisely, in accordance with a polynomial approximation in which there are both primary and secondary temperature coefficients, where the above $\alpha$ is the primary temperature coefficient. The larger this temperature coefficient, the greater the increase in resistance for a given increase in temperature.

If the voltage applied to a resistive heating layer is V and the resistance of that layer is R, then the electric heating power P is given by the equation $P=V^2/R=V^2R_o(1+\alpha t)$. Accordingly, if the temperature t increases, the resistance R will increase, causing the power P to decrease in inverse proportion thereto. The higher the temperature coefficient, the greater the decrease in electric heating power for a given increase in temperature; while with a low temperature coefficient, the same increase in temperature does not cause much of a decrease in electric heating power, and heater operation will continue unchanged.

From the foregoing, it can be understood that the high temperature coefficient resistance layer of the present invention can possess a spontaneous temperature controlling property of progressively converging the temperature to a constant value. Conversely, a decrease in temperature causes a decrease in resistance, thus increasing the electric heating power, which raises temperature. In other words, the high-temperature-coefficient resistance layer has the property of spontaneously constraining variations in temperature rising above or falling below the desired fixing temperature, thus providing a technology breakthrough in that it maintains a constant temperature, and does so without external circuitry. This property acts to quickly restore the heat roller to the fixing temperature, to thus correct for external circuit on/off control temperature ripple, and also heat roller location-wise temperature differences occurring after paper has passed. This property will be referred to as a 'temperature controlling property.'

However, this temperature controlling property of the high-temperature-coefficient resistance acts in opposition to rapid heat-up of the roller from room temperature to the fixing temperature, making rapid heating more difficult to achieve. To solve this problem, the inventors conceived a two-layer structure that includes a low-temperature-coefficient resistance layer along with the high-temperature-coefficient resistance layer. This third type of quick heat roller will be referred to as a self-temperature controlled quick heat roller. As discussed above, this low-temperature-coefficient resistance layer can be thought of as simply always being in a heating state, regardless whether temperature is increasing or decreasing.

Accordingly, when the roller starts to heat up from room temperature to the fixing temperature, both the high-temperature-coefficient resistance layer and the low-temperature-coefficient resistance layer are in a full heating state, and they therefore both serve to speed up the heating process. As the temperature rises, however, the heating effect of the high-temperature-coefficient resistance layer is reduced by its temperature-controlling-property, while the low-temperature-coefficient resistance layer, on the other hand, continues in its full heating state. Therefore, through the action of external circuit on-off control and the temperature control property of the high-temperature-coefficient resistance layer, the temperature is stabilized at the desired fixing temperature. If a temperature ripple due to external circuit on-off control now appears, or uneven temperature distribution across the length of the roller occurs due to the passage of paper, the high-temperature-coefficient resistance layer, through its temperature-controlling property, will act to attenuate these time-wise and location-wise temperature variations, to rapidly restore temperature stability. In this manner, both rapid heating, and an excellent ability to maintain stable temperature are made possible by a two-layer configuration comprising both high- and low-temperature-coefficient resistance layers, through what is referred to as a self-temperature controlled property.

Next, a specific structure common to all three of the above quick heat roller types, the toner-fixing quick heat roller, the temperature-controlled quick heat roller, and the self-temperature controlled quick heat roller, will be described.

First, a release layer of TEFLON is applied to the exterior surface of a metal pipe that will become the heat roller cylinder. The release layer helps the paper separate from the roller more easily. On the other hand, an electrical resistance heater sheet is fabricated by forming the following layers, in the order of insulation layer, resistive heating layer, insulation layer, and heat reflection layer. There are three different types of resistive heating layer: the first type is an ordinary resistive layer, the second type is a high-temperature-coefficient resistance layer, and the third type is actually a two-layer structure with both a high-temperature-coefficient resistance layer and a low-temperature-coefficient resistance layer. The order of placement (top/bottom) of the high- and low-temperature coefficient resistance layers is not important.

Next, this heater sheet is tightly bonded to the inside surface of the cylinder with the heat reflection layer being located toward the center of the cylinder. This puts an insulation layer in contact with the metal pipe, preventing leakage of electric current into the metal pipe.

If a pipe made of an insulator material is used for the cylinder, first a release layer is formed on its outer surface. In this case, the electrical resistance heater sheet is fabricated by forming the following layers in the order listed: resistive heating layer, insulation layer, heat reflection layer. The heater sheet is tightly bonded to the inside surface of the cylinder, with the heat reflection layer being located nearest the center of the cylinder. The insulating property of the pipe precludes current leakage even with the resistive heating layer in direct contact with the pipe.

The resistive heating layer forms a sheet that generates heat when an electric current passes through it. This layer can be made by applying a film of conductive paste containing a conductive powder having the desired temperature coefficient, or by laying down a prepared resistive film made of a material with that temperature coefficient. To adjust the resistance of the heating layer, if a prepared film is used, a film of a different thickness can be used, or with paste, the thickness applied can be varied. Thus, the heating power can be adjusted at will by changing the thickness of the resistive heating layer.

For the first type of roller, the toner-fixing quick heat roller, there are no particular restrictions with respect to the resistive heating layer material, and it must simply have the proper resistance for the intended use. Accordingly, the material used may be selected from the many currently available, commonly known conductor materials.

For the second type, the temperature controlled quick heat roller, a high-temperature-coefficient resistance material is used. For this material, metals such as Ag, Ni, Au, Pd, Mo, Mn, and W, alloys such as Ag—Pd, Cu—Ni, Cu—Zn, and Cu—Sn, or intermetallic compounds such as $V_2O_3$, $Sb_2O_3$, $Bi_2O_3$, and $CrO_2$ may be used. The temperature coefficients of the conductor materials in this list range from very high to very low, but they may all be used selectively as long as the selection provides the desired temperature controlling property.

The third type, the self-temperature controlled quick heat roller, requires both high- and low-temperature coefficient conductor materials. For the high-temperature-coefficient conductor material, metals such as Pd, Mo, and W, alloys such as Ag—Pd, Cu—Ni, Cu—Zn and Cu—Sn, or intermetallic compounds such as $V_2O_3$, $Sb_2O_3$, $Bi_2O_3$, and $CrO_2$ may be used. These materials may be used individually or mixed together, and commonly known materials other than these may also be used. These materials exhibit positive temperature coefficients of resistance, in relatively high values.

For the low-temperature coefficient conductor material in this third type of roller, metals such as Ag, Ni, Au, Pd, Mo, and W, or intermetallic compounds such as $Re_2O_3$, $Mn_2O_3$, and $LaMnO_3$ may be used. These materials may be used individually or mixed together, and commonly known materials other than these may also be used. These materials exhibit positive temperature coefficients of resistance, in relatively low values.

It will be noted that the materials listed as examples of low-temperature-coefficient conductor materials for the self-temperature controlled type include some of the same materials listed as high-temperature-coefficient conductors for the temperature-controlled-type. The self-temperature controlled type of quick heat roller has a two-layer structure comprising a low-temperature-coefficient resistance layer and a high-temperature-coefficient resistance layer. The self-temperature controlled property is due to the characteristics of the numerical differences between the two layers. On the other hand, in the temperature controlled type, the temperature control is accomplished by a single high-temperature-coefficient resistance layer. Thus, in this type, materials with relatively low temperature coefficients may be used as long as they provide the desired temperature control property.

The properties common to all three types of quick heat roller will be presented below.

For the resistive heating material, the materials that can be used include not only the above materials, but also a mixture in which glass or a synthetic resin that forms a matrix is added to these materials. A matrix can serve to increase the strength of the films produced, improve electrical resistance values, or optimize other materials science-type values.

Other known materials may also be added, as appropriate, in order to obtain a desired result. In particular, the glass can be effective in reducing changes in resistance caused by hot/cold temperature cycling.

The insulation layers insulate other layers from current from the resistive heating layer. These layers can be forned by applying an insulating paste, or laying down a prepared insulating film. Insulating materials that can be used may be divided into inorganic and organic insulating materials. Inorganic insulating materials include mica, marble, ceramics, and glass; while organic insulating materials include common materials such as fibers, plastics, rubber, waxes, and compounds. The material can be selected for the intended use based on its insulating properties and materials science-type properties. In particular, plastic film and similar substitutes form an extremely flat sheet that can be used "as is" for the insulation layers.

The heat reflection layer is a material that reflects heat rays, which is emitted from the resistive heating layer to the heat reflection layer either by tranission or direct transfer, toward the inner surface of the cylinder, thus improving the heating efficiency of the cylinder. Any mirror-like surface can serve as a heat reflecting surface, e.g., a metal film such as an aluminum foil with its reflective side properly oriented may be used for this layer. The heat reflection layer greatly reduces the heating time of the heat roller, and also contributes to energy conservation.

The heat reflection layer has significant effect in terms of the heating time performance of the heat roller; but even when no heat reflection layer is used, it provides a delayed cylinder temperature increase because dispersed heat accumulates inside the roller. In other words, this heat reflection layer may be omitted if the high-speed warm-up is not fully required. The layer configuration of the above electrical resistance heating sheet attached to the inner surface of the metal cylinder would then consist of a resistive heating layer sandwiched between two insulation layers; or if an insulating cylinder is used, it would consist of a resistive heating layer and one insulating layer. The insulation layer innermost in the cylinder, however, may also be eliminated if operation is stable without it. As for how the layers are formed, in addition to the methods described, other variations are also possible. In the self-temperature controlled quick heat roller, the resistive heating layer is made up of a high-temperature-coefficient resistance layer and a low-temperature-coefficient resistance layer. Here, for example, an insulation layer can be provided between the two resistance layers.

When the resistive heating layers are formed from conductive paste, and the insulation layers from insulating paste, then an easy way to do this is by screen printing. If conductive or insulating films are used, of course, they can be laid down "as is" as the layers, and adjustments in film thickness can also be made. In screen printing, the layer is applied through a desired hole pattern in the screen, by squeezing the paste through the holes onto substrate. In this method, the pattern can be changed by simply changing the screen, and the film thickness can also adjusted by performing two or three printings, one over the other. In this manner, the resistances of resistive heating layers and insulating properties of insulation layers can be set as desired.

Heat rollers thermally fix a toner image on a recording paper. Therefore, to avoid irregular toner fixing, it is important that a uniform temperature be maintained over the entire surface of the roller. In general, since heat tends to be lost by dispersion through the ends of the roller, the temperature distribution tends to be so that the temperature is higher in the middle of the roller and lower toward the ends. Therefore, to correct for this, the resistive heating layer is made progressively thinner (and thus higher in resistivity) toward the outer ends of the roller. This increases the heating effect toward the ends of the roller, effecting an even temperature distribution over the length of the roller. This thickness effect and the strong effect of the high- and low-temperature coefficients work together to provide a heat roller that maintains the temperature always at a constant value.

BEST MODE FOR CARRYING OUT THE INVENTION

The best mode for carrying out the present invention will be described as the embodiments below with reference to the drawings.

Embodiment 1

Toner-Fixing Quick Heat Roller.

Figure 1:
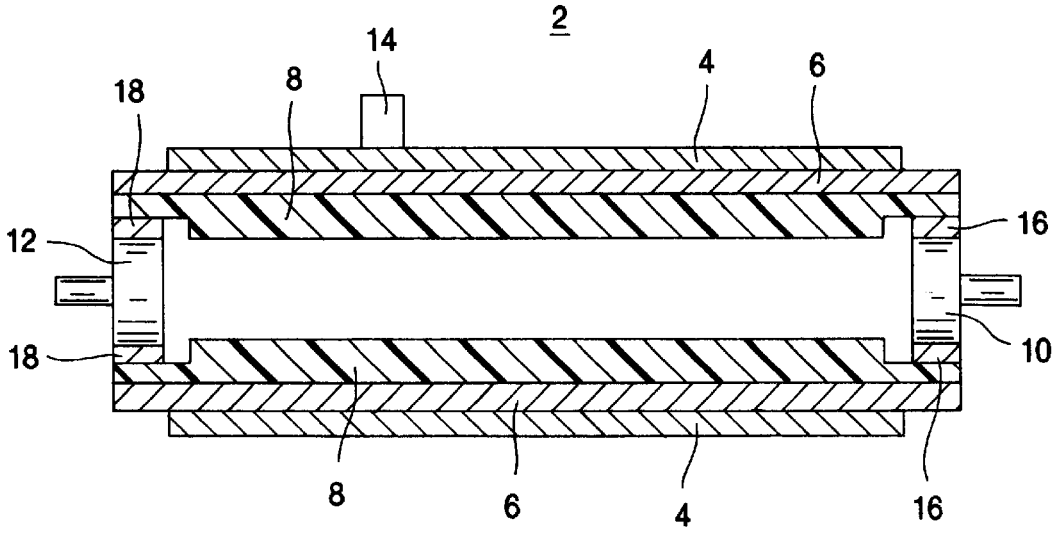
FIG. 1 shows the basic configuration of a toner-fixing quick heat roller according to a first embodiment of the present invention.

The first embodiment relates to a first type of quick heat roller: a toner-fixing quick heat roller. As shown in FIG. 1, the quick heat roller 2 of the present invention has a cylinder 6, a bare aluminum tube that has a release layer 4 formed on its outer surface, and an electrical resistance heater sheet 8 bonded by adhesive to its inner surface. The reference numerals 10 and 12 designate electrical connection terminals, and 14 refers to a thermistor for measuring temperature. The reference numerals 16 and 18 designate counterelectrode layers, which will be described later and are connected to the electrical connection terminals 10 and 12 to provide current to a resistive heating layer 22.

Figure 2:
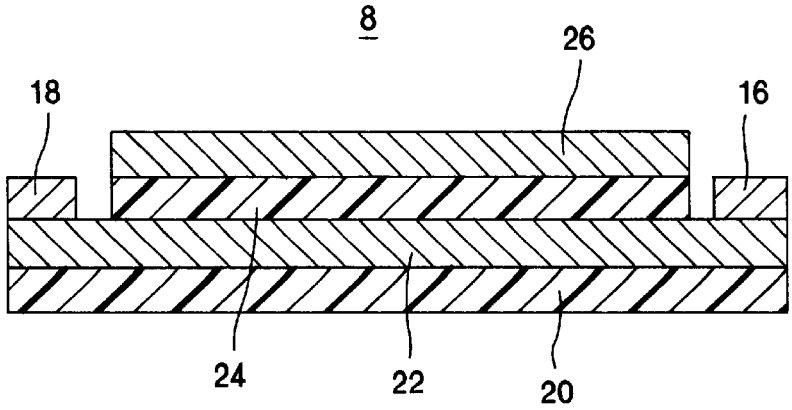
FIG. 2 shows the layer configuration of an electrical resistance heater sheet used in the toner-fixing quick heat roller of the first embodiment.

FIG. 2 shows a cross-section of the electrical resistance heater sheet 8. A resistive heating layer 22 is formed by a screen printing method on the surface of an insulation layer 20 (a 4–10 $\mu$m-thick polyimide resin film), and a 4–10 $\mu$m-thick polyimide resin film insulation layer 24 is formed on top of that. The thickness of the films may be adjusted during fabrication. An aluminum foil heat reflection layer 26 is attached to the upper surface of the insulation layer 24 to complete the heater sheet 8. The counterelectrode layers 16 and 18 are formed on the two ends of the resistive heating layer 22 by applying a conductive coating in a screen printing method, after which they are connected and secured to the electrical connection terminals 10 and 12 through a conductive adhesive. The electrical connection terminals 10 and 12 are supported by insulating bearings provided in the equipment bulkheads. Current supplied from an external power source is conducted though the terminals 10 and 12 for heating and control of the resistive heating layer 22. The quick heat roller 2 is heated to a prescribed temperature set by the temperature measurement thermistor 14, with electrical power controlled by a control circuit not shown in the drawing. Because the resistive heating layer 22 is formed to be thinner toward its ends, the heating effect is greater near the ends, which makes up for heat lost from that part of the roller by dispersion through the bearings. This makes the heating temperature uniform over the entire length of the resistive heating layer 22.

The resistance heating material is a mixture consisting of a conductor in a synthetic resin or glass matrix. In this embodiment, a conductor material comprising Ag and Ni is used as the main component, and this is mixed with glass in a matrix to form a flowable conductive paste. A film of this conductive paste is then formed by applying the paste in the desired pattern, by screen printing.

When glass is used for the matrix, any change in resistance caused by hot/cold temperature cycling will be minimized. Also, the use of a synthetic resin or glass matrix improves the solid-state property values (film strength, etc.) of the resistive heating layer. The content percentage range for the conductive material is put at 90–10 wt. %, and that of the matrix material at 10–90 wt. %. A good range of thicknesses for the resistive heating layer 22 is 5–100 $\mu$m, while the most preferred thickness range is 20–60 $\mu$m. The wt. % and thickness, however, are not limited to these numerical values. The numbers can in fact be adjusted as desired to satisfy requirements with respect to heating time performance, high temperature holding performance, and temperature distribution performance.

For the materials used in the cylinder 6, counterelectrode layers 16 and 18, and electrical connection terminals 10 and 12, the materials should be selected so that the differences in thermal expansion coefficient are as small as possible. For the resistivity of the conductor material in the electrical resistance heater sheet 8, the insulating properties of the insulation layers 20 and 24, and their melting points and other materials-type parameters, the best values for the intended purpose should be selected.

Next, a method for manufacturing the quick heat roller 2 of the present embodiment will be described. First, an aluminum pipe is machined to the prescribed shape, a release layer 4 of TEFLON is spray-coated on the surface of the pipe, and the pipe then baked at approximately 300° C. for 30 minutes. The bare inside surface of the aluminum pipe is coated with adhesive, and an electrical resistance heater sheet 8 is bonded to it.

The methods that may be used for this bonding include an inside pressure expansion method such as a blow or bulge technique. In this technology, a sealed unit used as an inner die is filled with gas or liquid. This sealed unit is then pressurized, which causes it to expand, pressing against an outer die. If adhesive is applied to the outer die, an electrical resistance heater sheet need simply be placed between the inner and outer die to bond it securely to the inner surface of the outer die. In another possible method, opposite electric charges are established on the cylinder and sheet, and the resulting attractive force draws them tightly together. There are other methods that are also used.

As a specific example, the blow method will be described. First, the electrical resistance heater sheet 8 is wrapped around the outside of a hollow rubber pipe, one end of which is sealed. This hollow rubber pipe is then placed inside the bare aluminum tube, and compressed air is fed into it. The rubber pipe expands from the inside, effecting a tight bond between the electrical resistance heater sheet 8 and the inner surface of the bare aluminum tube. Next, the adhesive is heat-cured at 300° C. for 30 minutes. Finally, electrical connection terminals 10 and 12 are attached at prescribed locations using conductive adhesive, thus completing the toner-fixing quick heat roller 2.

The heating time characteristic of the quick heat roller of this first embodiment was compared with that of a conventional heat roller. Two versions of the present embodiment were prepared for the comparison: one with a heat reflection layer 26, and one without. A 650 W halogen lamp heat roller was used as an example of a conventional heat roller.

Following is a detailed description of how the comparison samples were fabricated. First, a 10 $\mu$m-thick polyimide resin sheet was secured to a flat glass plate as an insulation layer 20. The resistance heating material for the heater sheet was produced by using, for the conductor material, Ag and Ni for the main component, in a synthetic resin vapor matrix with a 50% glass content. An electrical resistance heater sheet (approximately 11.7 ohms) was then fabricated by applying this material to the polyimide resin sheet in three screen printing operations. In the first screen printing, a resistive heating layer 22 was formed. The second screen printing adjusted the film thickness distribution of the resistive heating layer to effect uniform temperature distribution across the surface of the layer. In the third screen printing operation, the counterelectrode layers 16 and 18 (conductive layers) were formed. Next, a polyimide resin sheet was bonded over the resistive heating layer 22 as an insulation layer 24. Finally, an aluminum foil heat reflection layer 26 was bonded to the insulation layer 24 to complete the electrical resistance heater sheet 8.

This electrical resistance heater sheet 8 was then cemented to the inside surface of a bare aluminum tube having an outside diameter of 20 mm, a length of 283 mm, and a thickness of 0.9 mm. Electrical connection terminals 10 and 12 were then bonded in place using conductive adhesive, thus completing the quick heat roller 2. A second quick heat roller 2 was similarly fabricated without a heat reflection layer. Applying a voltage of 100 V to these quick heat rollers resulted in a current flow of approximately 8.5 A with an input power of 850 W.

Figure 3:
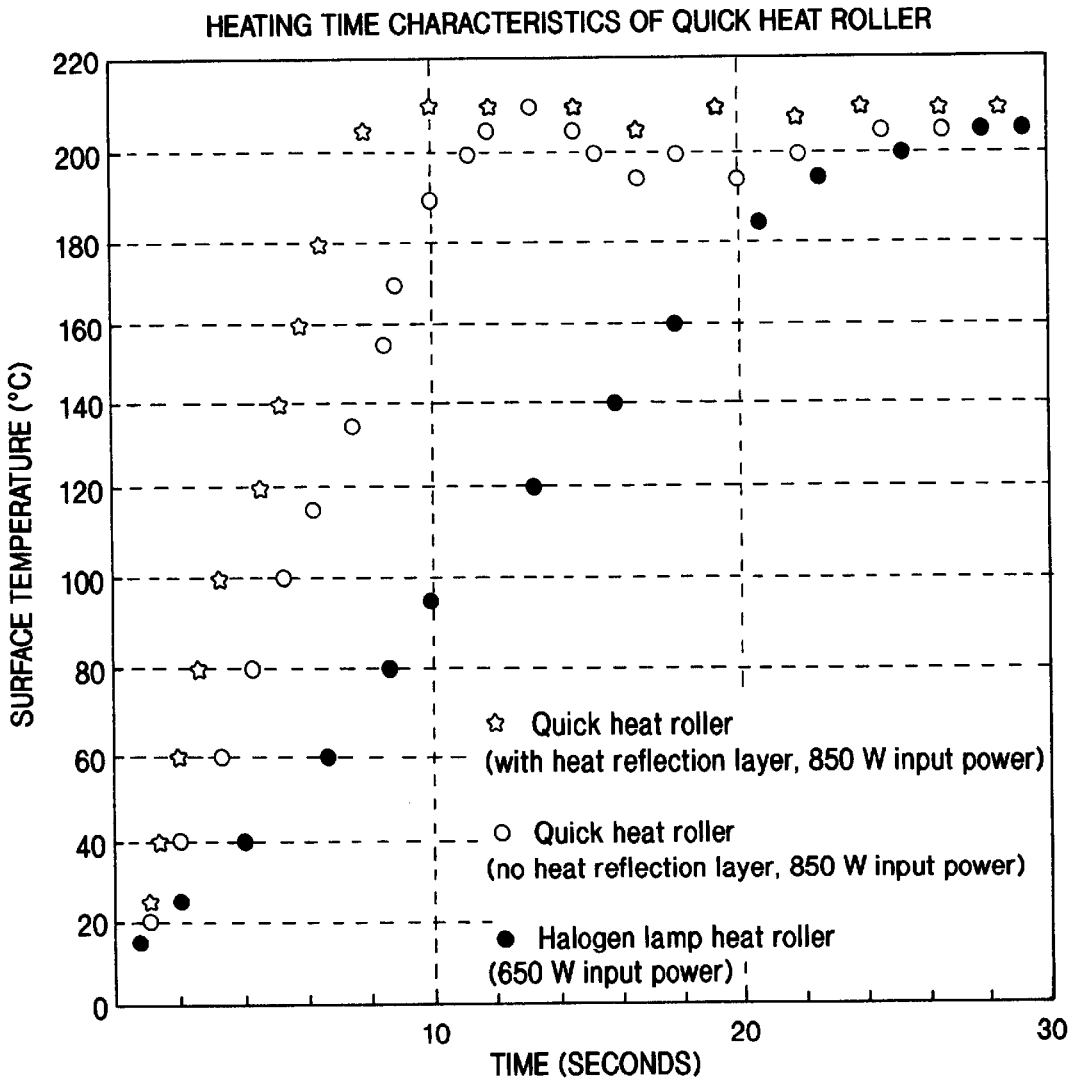
FIG. 3 is a graph comparing the heating time characteristic of the toner-fixing quick heat rollers of the first embodiment with that of a conventional heat-lamp-type heat roller.

The heating time characteristics of the three heat rollers described above are shown in FIG. 3. The curve indicated by solid dots (●) represents the heating time characteristic of the commonly used halogen lamp heat roller (650 W) shown for comparison. The curve indicated by open circles (○) shows the heating time characteristic of the toner-fixing quick heat roller without a heat reflection layer (850 W), and the curve indicated by open stars (☆) shows the characteristic of the same roller with a heat reflection layer. The halogen lamp required 17 seconds to heat the surface to 160° C., the quick heat roller with no heat reflection layer required about 9 seconds, and the quick heat roller with an addition of a heat reflection layer reduced this to 6 seconds, a huge improvement.

Thus it was found that the heat reflection layer made a major contribution to heating efficiency in that it reduced the time required to reach the fixing temperature to ⅔ that required when no heat reflection layer was provided. Compared to a conventional halogen lamp, the time required to reach the fixing temperature was reduced to approximately ½ without, and ⅓ with, the heat reflection layer; thus revealing the excellent advantage afforded by the present invention over the light source heating tubes of the past. Moreover, because the electrical resistance heater sheet is enclosed in a cylinder, it is not subject to friction or damage due to external force, and can therefore achieve a much longer service life.

Embodiment 2

Temperature Controlled Quick Heat Roller.

The second embodiment relates to a second type of quick heat roller called a temperature controlled quick heat roller. The structure of the heat roller per se is the same as that shown in FIG. 1, and will not be described.

Figure 4:
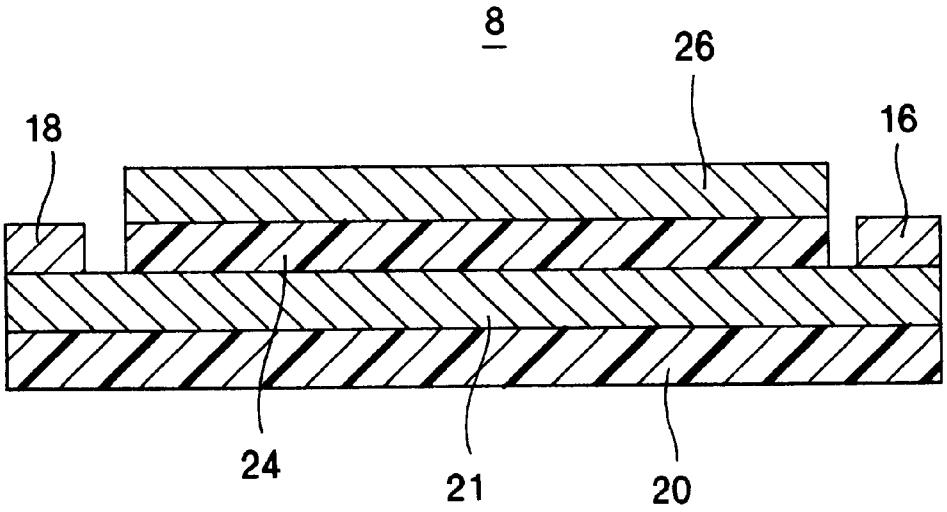
FIG. 4 shows the layer configuration of an electrical resistance heater sheet used in the temperature controlled quick heat roller according to a second embodiment of the present invention.

FIG. 4 shows the layer configuration of the electrical resistance heater sheet used in the temperature controlled toner-fixing quick heat roller. In this configuration, a high-temperature-coefficient resistance layer 21, applied by screen printing, replaces the resistive heating layer 22 of FIG. 2. The remainder of the configuration is the same as that of FIG. 2, and a description thereof will therefore not be presented.

In the high-temperature-coefficient resistance layer 21, heating electrical power is inversely proportional to resistance; thus heating electrical power is also inversely proportional to heating temperature. Once a heat roller reaches the prescribed temperature, when temperature irregularities occur due to phenomena such as temperature ripple or paper passing over the roller, the temperature controlling property quickly corrects irregularities in temperature such as to always maintain the heat roller temperature constant. It is, therefore, possible to produce copies without irregularities, providing outstanding print capability.

The material used for the high-temperature-coefficient resistance material is a mixture consisting of a conductor combined with synthetic resin or glass matrix. In the present embodiment the material used for the high-temperature-coefficient resistance conductor material comprised Ag and Ni as the main component, and this was mixed in a glass matrix to form a flowable conductive paste. A film of this conductive paste was applied by screen printing to form the desired pattern.

Next, the heating time characteristic of the quick heat roller of embodiment 2 was compared with a prior heat roller. Two versions of the roller of embodiment 2 were prepared: one with a heat reflection layer 26, and one without. The prior heat roller used for comparison was a 650 W halogen lamp. For further comparison, an 850 W quick heat roller with a heater member having a resistive heating layer without a high-temperature coefficient was included.

Figure 5:
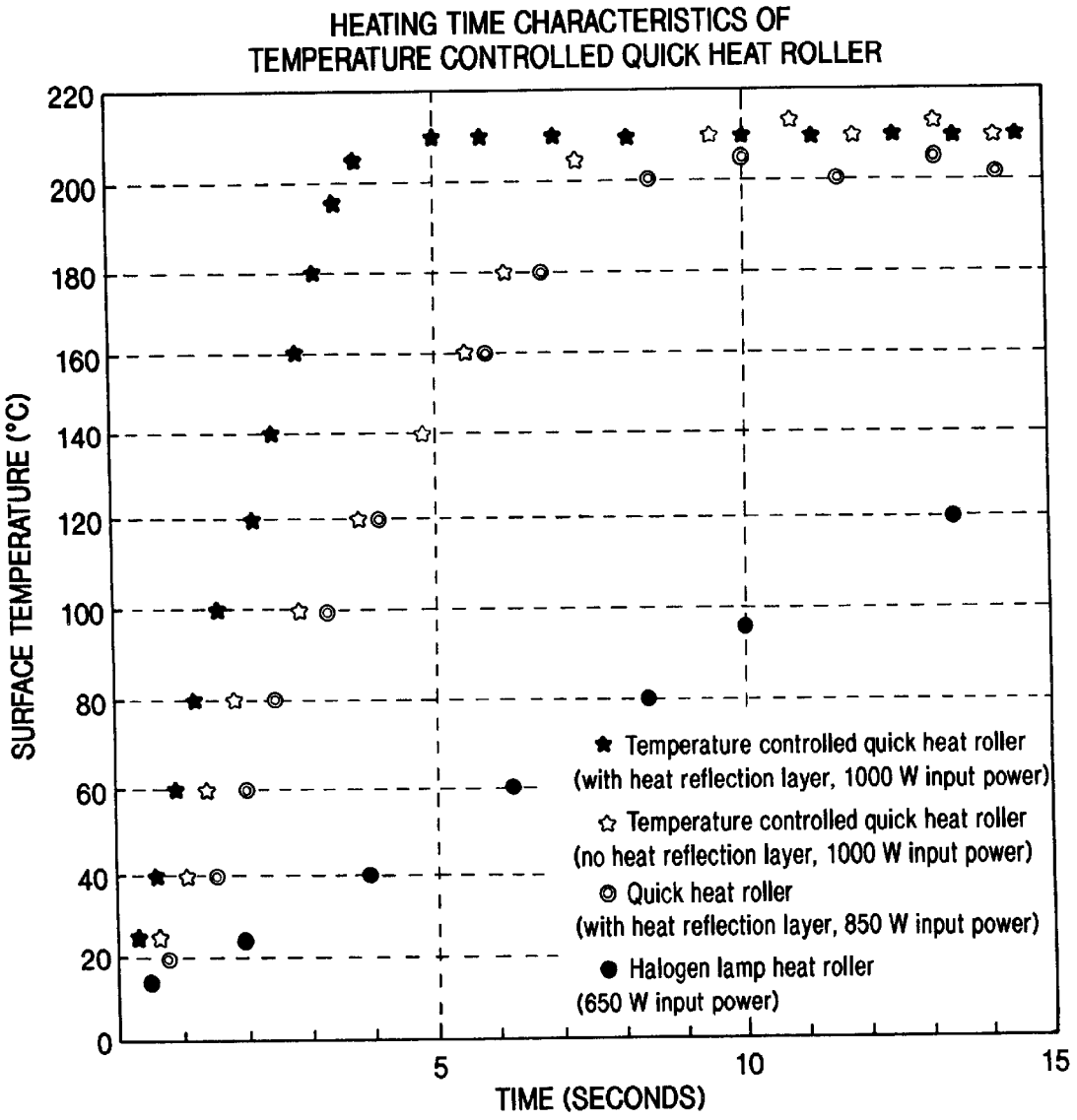
FIG. 5 is comparing the heating time characteristic of temperature controlled quick, at rollers of the second embodiment with those of other heat rollers.

The heating time characteristics of these four heat rollers are shown in FIG. 5. The curve indicated by solid dots (●) represents the heating time characteristic of the commonly used halogen lamp heat roller (650 W) shown for comparison. The curve indicated by open stars (☆) shows the characteristic for a temperature controlled quick heat roller without a heat reflection layer (1000 W), and the curve marked by solid stars (★), shows the characteristic for the same roller with a heat reflection layer. The curve indicated by concentric circles (◎) shows the heating time characteristic of the quick heat roller having a heat reflection layer (850 W). It required 14 seconds for surface of the halogen lamp roller to reach 120° C. The quick heat roller required four (4) seconds to reach the same temperature. The temperature-controlled quick heat roller without a heat reflection layer also required about four (4) seconds. By comparison, this was shortened dramatically to only two (2) seconds by the addition of a heat reflection layer.

In other words, the ratio of the heating times for these four heat rollers can be shown to be 2:4:4:14 (★:☆:◎:●). From this comparison, it can be seen that the time required for a temperature controlled quick heat roller that has a heat reflection layer to reach the fixing temperature is only ⅐ that of a roller that has a halogen lamp heat source, thus demonstrating that an ultra-fast heating heat roller was indeed realized. The test also highlighted the major contribution made by the heat reflection layer toward improved heating efficiency. In addition, a comparison of both quick heat rollers having a heat reflection layer shows that the time required for the temperature controlled quick heat roller to reach fixing temperature is only half that of a non-temperature-controlled quick heat roller, clearly demonstrating the efficacy of the high-temperature-coefficient-resistance material.

Compared to a conventional halogen lamp heat roller, the quick heat roller without a heat reflection layer reduced the time required to reach fixing temperature to ⅓.5, while the quick heat roller with a heat reflection layer reduced it to ⅐, clearly demonstrating the amazing degree to which the present invention excels over conventional heat rollers using heat lamps. Moreover, because the electrical resistance heater sheet of the present invention is enclosed in a cylinder, it is not subject to friction or damage due to external force, and can therefore achieve a much longer service life.

A description will be made regarding the temperature ripple phenomenon. Though not determined from FIG. 5, it took the halogen lamp roller approximately 24 seconds to reach 200° C., after which a large ripple phenomenon due to on/off control occured. A small ripple also appeared with a quick heat roller. In comparison, however, in the present invention with a heat reflection layer, absolutely no evidence of ripple phenomenon could be found, and roller temperature was maintained constant extremely well over the long term. Even without a heat reflection layer, there was ahnost no ripple. This clearly demonstrates the outstanding advantages of the present invention.

Embodiment 3

Self-temperature controlled Quick Heat Roller.

Described below as embodiment 3 of the present invention is the third type which is the self-temperature controlled quick heat roller. The configuration of the heat roller per se is the same as that of FIG. 1 and therefore will not be described.

Figure 6:
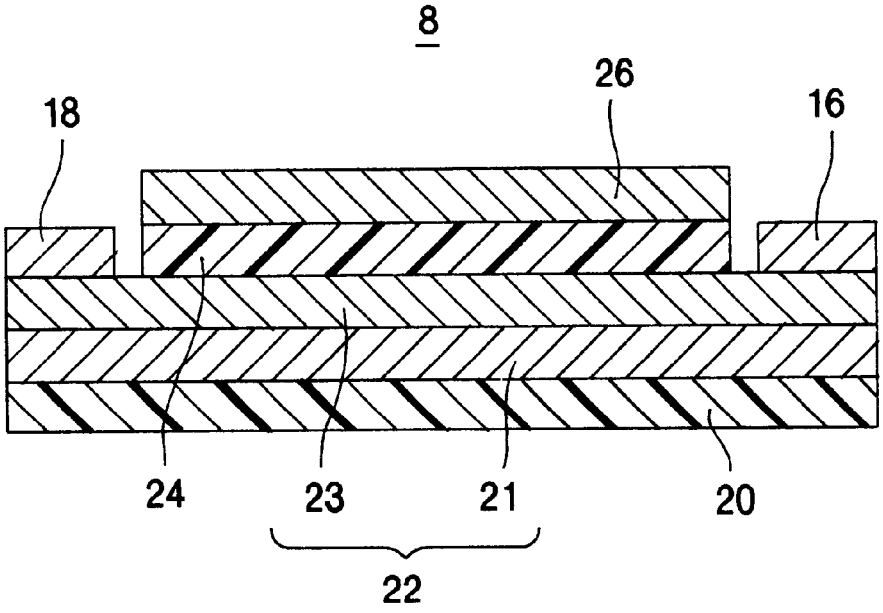
FIG. 6 shows the layer configuration of the electrical resistance heater sheet used in a self-emperature controlled quick heat roller according to a third embodiment of the present invention.

FIG. 6 shows the layer configuration of the electrical resistance heater sheet used in the self-temperature controlled quick heat roller. In this configuration, provided as the resistive heating layer 22 of FIG. 2 comprises superimposed high-temperature-coefficient resistance layer 21 and low-temperature-coefficient resistance layer 23 films, both of which are applied by a screen printing method. The relative (top/bottom) positions of the two resistance layers 21 and 23 may be reversed. The configuration of the other layers is the same as in FIG. 2, and will not be discussed.

As described above, the high-temperature-coefficient resistance layer 21 has temperature control characteristics, and the low-temperature-coefficient resistance layer 23 has heating effect; accordingly, they function together to quickly and uniformly restore the temperature to the set value when temperature ripple or other temperature irregularities appear in various members. Therefore, after the heat roller reaches the prescribed temperature, when temperature irregularities occur due to phenomena such as temperature ripple or paper passing over the roller, this self-temperature controlled property quickly corrects irregularities in temperature so as to always hold the heat roller temperature constant. This fast response makes it possible to produce copies without irregularities, thus providing outstanding print capability.

The material used for the low-temperature-coefficient resistance material is a conductor mixed in a synthetic resin or glass matrix. In the present embodiment the material for the low-temperature-coefficient resistance material conductor main component comprises Ag, Ni, Au, Mo, and W, and this is mixed in a glass matrix to form a flowable conductive paste. A coating film of this conductive paste was applied by screen printing to form the desired pattern.

Likewise, the material used for the high-temperature-coefficient resistance material is a mixture of a conductor combined in a matrix with synthetic resin or glass. In this embodiment, the material for the high-temperature-wefficient resistance material conductor uses an intermetallic compound of $V_2O_3$, $Sb_{23}O_3$, $Bi_2O_3$, and $CrO_2$. This was mixed in a glass matrix to form a flowable conductive paste. A coating film of this conductive paste was applied by screen printing to form the desired pattern.

When glass is used for the matrix, the amount of resistance variation caused by hot/cold temperature cycling will be small. Also, the use of a synthetic resin or glass for the matrix improves the solid-state property values of the resistive heating layer (such as film strength). The content percentage range for the conductive material is put at 90–10 wt. %, and that of the matrix material at 10–90 wt. %. A good range of thickness for the high/low-temperature-coefficient resistance layers 21 and 23 is 5–100 $\mu$m, while the most highly preferred thickness range is 20–60 $\mu$m. The wt. % and thickness, however, are not limited to these numerical values. The numbers can in fact be adjusted as desired to satisfy requirements with respect to heating time performance, high temperature holding performance, and temperature distribution performance.

The heating time characteristic of the quick heat roller of embodiment three was compared with a conventional heat roller. Two versions of the roller of embodiment three were prepared: one with a heat reflection layer 26, and one without. The conventional heat roller in the comparison used a 650 W halogen lamp. For further comparison, an 850 W quick heat roller with a heater member having a resistive heating layer comprising only a low-temperature-coefficient resistance layer was also tested.

Following is a detailed description of how the comparison samples were fabricated. First, a 10 $\mu$m-thick polyimide resin sheet was secured to a flat glass plate as an insulation layer 20. For the conductor material, the high-temperature-coefficient and low-temperature-coefficient resistance materials were prepared as described above. Films of these resistance materials were applied to the above polyimide resin sheet in five screen printing operations to fabricate the electrical resistance heater sheet (approximately 10 ohms). In the first screen printing, a high-temperature-coefficient resistance layer 21 was formed. The second screen printing adjusted the film thickness distribution of the high-temperature-coefficient resistance layer to provide uniform temperature distribution across the surface of the layer. In the third screen printing operation, a low-temperature-coefficient resistance layer 23 was formed. The fourth screen printing adjusted the film thickness distribution of the low-temperature-coefficient resistance layer to provide uniform temperature distribution across the surface of the layer. In the fifth screen printing, the counterelectrode layers 16 and 18 (conductive layers) were formed. Next, a polyimide resin sheet was bonded over the low-temperature-coefficient resistance layer 23 as an insulation layer 24. Finally, an aluminum foil heat reflection layer 26 was bonded on the insulation layer 24 to complete the electrical resistance heater sheet 8.

Applying a voltage of 100 V to this self-temperature controlled quick heat roller resulted in 5 A of current in each of the high-temperature-coefficient and low-temperature-coefficient resistance layers, for an input power of approximately 1000 W.

Figure 7:
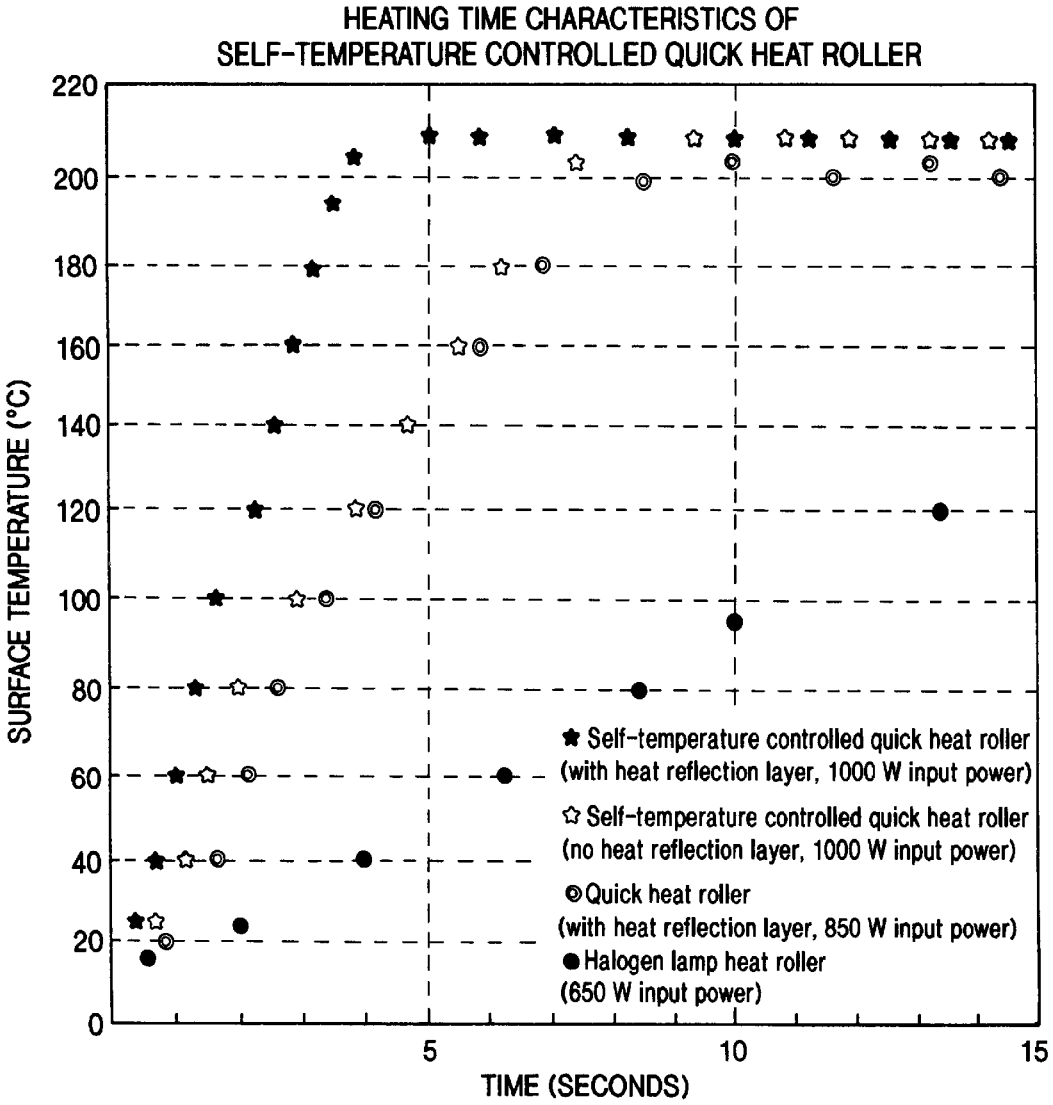
FIG. 7 is a graph comparing heating time characteristic of the self-temperature controlled quick heat roller of the third embodiment with those of other heat rollers.

The heating time characteristics of these four heat rollers are shown in FIG. 7. The curve indicated by solid dots (●) represents the heating time characteristic of the commonly used halogen lamp heat roller (650 W) shown for comparison. The curve indicated by open stars (▼) shows the characteristic for a self-temperature controlled quick heat roller without a heat reflection layer (1000), and the curve marked by solid stars (★) shows the characteristic for the same roller with a heat reflection layer. The curve indicated by concentric circles (◎) shows the heating time characteristic of a quick heat roller with a heat reflection layer (850). For ease of comparison, based on the data in FIG. 7, although it is below the fixing temperature, a surface temperature of 120° C. was selected for comparison. It required 14 seconds for surface of the halogen lamp roller to reach 120° C. The quick heat roller required about four (4) seconds to reach the same temperature. The self-temperature controlled quick heat roller without a heat reflection layer also required about four (4) seconds. By comparison, this was shortened dramatically to only two (2) seconds by the addition of a heat reflection layer.

In other words, the ratio of the heating times for these four heat rollers was shown to be 2:4:4:14 (★:☆:◎:●). From this comparison, it can be seen that the time required for a self-temperature controlled quick heat roller with a heat reflection layer to reach high temperature is only 1/7 that of a roller with a halogen lamp heat source, thus demonstrating that an ultra-fast heating heat roller had been obtained. It also highlights the major contribution made by the heat reflection layer toward improved heating efficiency. In addition a comparison of both quick heat rollers having a heat reflection layer shows that the time required for the self-temperature controlled quick heat roller to reach fixing temperature is only half that of a non-self-temperature controlled quick heat roller, clearly demonstrating the efficacy of the high/low-temperature-coefficient-resistance materials.

Compared to a conventional halogen lamp heat roller, the quick heat roller without a heat reflection layer reduced the time required to reach fixing temperature to approx. 1/3.5, while the quick heat roller with a heat reflection layer slashed it to approx. 1/7, clearly demonstrating the amazing degree to which the present invention excels over conventional heating lamp-type rollers. Moreover, because the electrical resistance heater sheets of the present invention are enclosed in cylinders, they are not subject to fiction, or to damage from external force, and can therefore achieve a much longer service life.

A description will be made regarding the temperature ripple phenomenon. Though not determined from FIG. 7, it took the halogen lamp roller approximately 24 seconds to reach 200° C., after which a large ripple phenomenon due to on/off control was apparent. A small ripple also appeared with a quick heat roller. In comparison, however, in the present invention with a heat reflection layer, absolutely no evidence of ripple phenomenon could be found, and roller temperature was extremely well-maintained over the long term. Even without a heat reflection layer, almost no ripple occurred. This clearly demonstrates the outstanding advantages of the present invention.

The present invention is not to be construed as being limited to the above embodiments. It goes without saying that a wide range of variations of form, and changes in the design can indeed be made without departing from the scope of the technical concepts of the present invention.

INDUSTRIAL APPLICABILITY

In accordance with claim 1, easy fabrication of an electrical resistance heater sheet is possible. Moreover, because heating is performed by a resistive heating layer, heating efficiency is high, and excellent heating time performance is provided. Also, because the heating element is entirely contained within the heat roller, the heating element is not subject to wear or damage due to external force, which ensures an extended service life. In particular, because of the heating efficiency described above, digital equipment such as electrophotographic equipment, color copiers, printers, etc. is able to complete its warm up in the time it takes to receive a signal of an image to be reproduced, and waiting time is, therefore, eliminated. Thus, the quick heat roller does not need to be activated until the signal is actually being transmitted, making a major contribution in terms of energy conservation.

In accordance with claim 2, because the roller uses a high-temperature-coefficient resistance layer, temperature irregularities are rapidly resolve; and a constant temperature can thus be strictly maintained over the entire heat roller. The effects of claim 1 are also obtained.

In accordance with claim 3, because the roller uses a high-temperature-coefficient resistance layer and a low-temperature-coefficient resistance layer, both a rapid rise to operating temperature and rapid resolution of temperature irregularity are achieved. Moreover, temperature ripple is strictly constrained and a constant temperature maintained over the entire heat roller. The effects of claim 1 are also obtained.

In accordance with claim 4, because a heat reflection layer is provided, loss of heat is prevented, which provides an advantage in that a concentration of heat can be directed toward the heating of the roller, thus improving heating time performance and high temperature operation.

Claim 5 specifies the invention of claims 1 through 3 in a more concrete manner. By rendering the electrical resistance heater sheet in a three-layer configuration, it enhances the utility and manufacturability of the heat roller.

Claim 6 specifies the invention of claims 1 through 3 in a more concrete manner. By providing the electrical resistance heater sheet in a four-layer configuration, it enhances the utility and manufacturability of the heat roller, and enhances the degree to which the present invention can be applied in industry.

In claim 7, screen printing is used to obtain the electrical resistance heater sheet, making mass production of the present invention possible, and providing the products of the invention to the market at low cost.

What is claimed is:

1. A temperature-controlled quick heat roller, said heat roller comprising an electrical resistance heater sheet provided on an inner surface of a cylinder, and said electrical resistance heater sheet is comprised of at least a high-temperature-coefficient resistance layer; wherein said high-temperature-coefficient resistance layer is heated by electric current, thus setting said cylinder to a prescribed fixing temperature, so that said heat roller has a property in which heating electrical power drops as temperature thereof rises.

2. A self-temperature controlled quick heat roller, said heat roller comprising an electrical resistance heater sheet provided on an inner surface of a cylinder, and said electrical resistance heater sheet is comprised of at least a resistive heating layer comprising a high-temperature-coefficient resistance layer and a low-temperature-coefficient resistance layer, wherein said high- and low-temperature-coefficient resistance layers are heated by electric current, thus setting said cylinder to a prescribed fixing temperature, so that said heat roller has a self-temperature controlled property in which heating electrical power drops as temperature thereof rises.

3. A quick heat roller according to any one of claims 1 through 2, wherein a heat reflection layer is provided outermost on one surface of said electrical resistance heater sheet, and said heat reflection layer is placed innermost in said cylinder.

4. A quick heat roller according to any one of claims 1 through 2, wherein said electrical resistance heater sheet is a layered sheet of a three-layer configuration in which a first insulation layer, a resistive heating layer and a second insulating layer are layered in that order; and said electrical resistance heater sheet is tightly bonded to said inner surface of said cylinder.

5. A quick heat roller according to claim 1, wherein said electrical resistance heater sheet is a layered sheet of a four-layer configuration in which a first insulation layer, a resistive heating layer, a second insulating layer, and a heat reflection layer are layered in that order; and said electrical resistance heater sheet is tightly bonded to said inner surface of said cylinder.

6. A quick heat roller according to claim 5, wherein at least said resistive heating layer of said electrical resistance heater sheet is made by a screen printing method, and a thickness of said resistive heating layer is controlled by way of multi-layer printing.

* * * * *